US005755593A

United States Patent [19]

Pepe

[11] Patent Number: 5,755,593

[45] Date of Patent: May 26, 1998

[54] ELECTRICAL OUTLET HAVING PANEL MOUNT LATCHES

[75] Inventor: Paul John Pepe, Winston-Salem, N.C.

[73] Assignee: The Whitaker Corporation, Wilmington, Del.

[21] Appl. No.: 807,308

[22] Filed: Feb. 27, 1997

[51] Int. Cl.[6] ..... H01R 13/74

[52] U.S. Cl. ..... 439/557; 439/567; 248/27.3

[58] Field of Search ..... 439/557, 567, 439/558, 555, 552, 535, 536; 248/27.1, 27.3

[56] References Cited

U.S. PATENT DOCUMENTS

| | | | |
|---|---|---|---|
| 2,757,353 | 7/1956 | Opalenik et al. | 439/552 |
| 4,717,358 | 1/1988 | Chaundy | 439/557 |
| 5,302,139 | 4/1994 | Starsja | 439/544 |
| 5,660,564 | 8/1997 | Yamanashi et al. | 439/557 |

*Primary Examiner*—Neil Abrams
*Assistant Examiner*—Tho Dac Ta
*Attorney, Agent, or Firm*—Robert Kapalka

[57] ABSTRACT

An electrical outlet which is mountable over a cutout of known size in a wall panel wherein the known size is one in a range of different standard sizes. The outlet comprises a base which is dimensioned to extend across the cutout and a plurality of latch arms attached to the base. The latch arms are arranged in arrays of different sizes corresponding to the different standard sizes of the cutout. At least one of the latch arms in a relatively large size array is selectively detachable from the base, wherein a largest remaining array corresponds to the known size of the cutout. In one embodiment, the base includes a plate which is confrontable with the wall panel, and the latch arms extend forwardly from the plate and then rearwardly through respective apertures in the plate and continue rearwardly through the cutout in the panel, and each of the latch arms has a projection with an inclined trailing face that is engageable with the wall panel.

8 Claims, 3 Drawing Sheets

ELECTRICAL OUTLET HAVING PANEL MOUNT LATCHES

FIELD OF THE INVENTION

The invention relates to an electrical outlet which has latches for securing the outlet over a cutout in a wall panel.

BACKGROUND OF THE INVENTION

Modular office furniture partitions typically include raceways which serve as conduits for electrical wires. The raceways typically have cutouts which permit access to the wires in the raceways. The wires are terminated in an outlet having electrical connectors that serve as junctions between the wires in the raceways and external wires running to office equipment. The outlet may be mounted over or in the cutout in the raceway.

A known outlet which is sold under the trademark FLEX-MODE by AMP Incorporated of Harrisburg, Pa., comprises a faceplate which holds one or more electrical connectors and which has latches which enter a cutout in a wall panel for securing the faceplate on the wall panel over the cutout. A problem occurs due to the fact that manufacturers of office furniture provide cutouts in different standard sizes, thereby requiring a different faceplate with a different array of latches for each standard size. Further, different cutouts of the same standard size can vary in dimension due to manufacturing tolerances, and the latches are not adequate to firmly hold the faceplate over a cutout at the large end of the dimensional range. In order to accommodate the largest cutouts, resilient spacer tubes are provided. The spacer tubes take up any gaps between the latches and edges of the cutout. However, the spacer tubes are small, individual components which can be easily lost or misplaced. There is a need for latching system which can accommodate cutouts in a range of standard sizes and dimensional variations.

SUMMARY OF THE INVENTION

The invention is an electrical outlet which is mountable over a cutout of known size in a wall panel wherein the known size is one in a range of different standard sizes. The outlet comprises a base which is dimensioned to extend across the cutout and a plurality of latch arms attached to the base. The latch arms are arranged in arrays of different sizes corresponding to the different standard sizes of the cutout, with the latch arms in each of the arrays being configured for engaging the panel when extending through the corresponding size cutout. At least one of the latch arms in a relatively large size array is selectively detachable from the base, wherein a largest remaining array corresponds to the known size of the cutout.

In one embodiment, the base includes a plate which is confrontable with the wall panel, and the latch arms extend forwardly from the plate and then rearwardly through respective apertures in the plate and continue rearwardly through the cutout in the panel, and each of the latch arms has a projection with an inclined trailing face that is engageable with the wall panel.

BRIEF DESCRIPTION OF THE DRAWINGS

The invention will now be described by way of example with reference to the accompanying drawings wherein.

DETAILED DESCRIPTION OF THE PREFERRED EMBODIMENT

Figure 1:
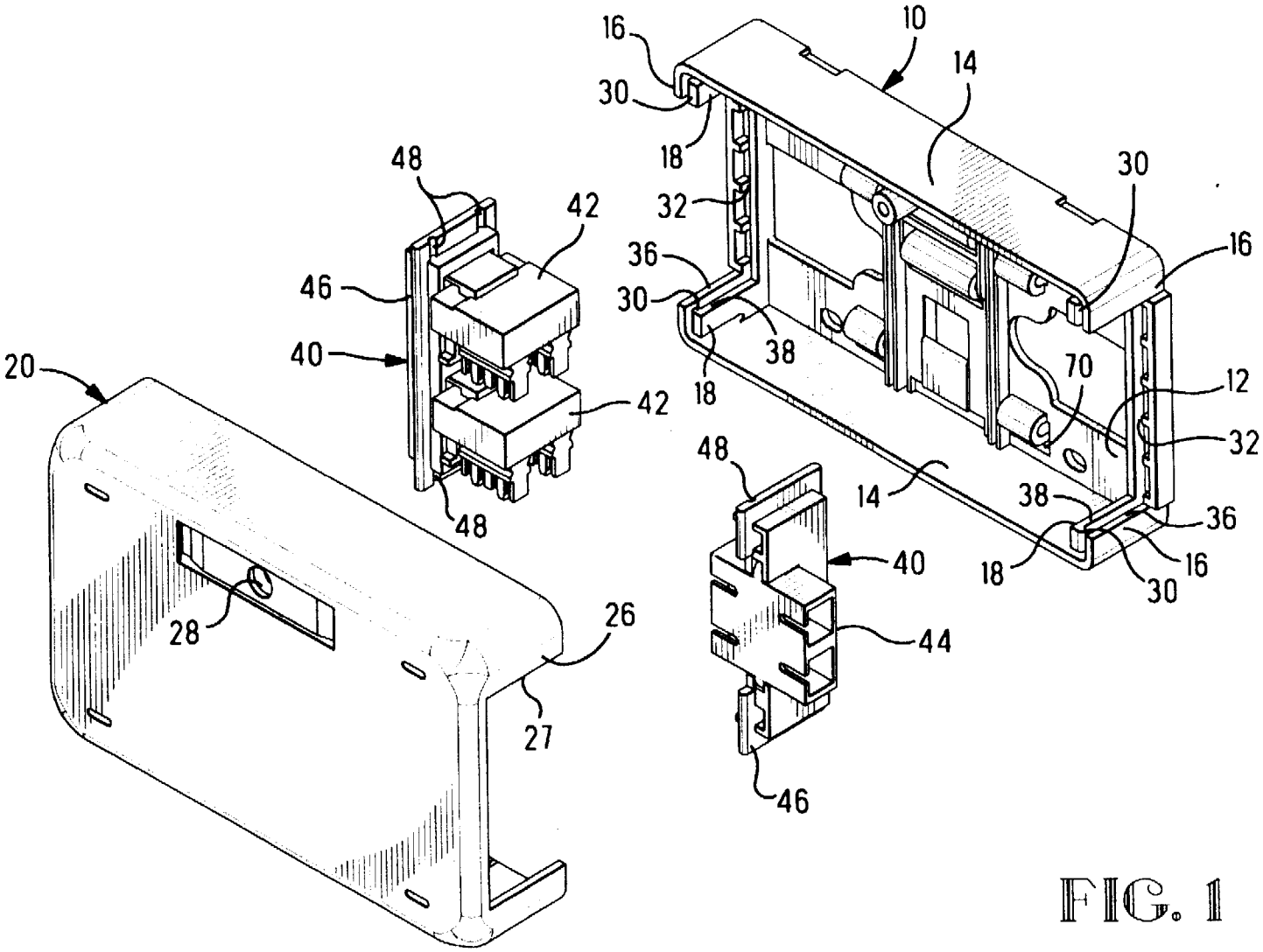
FIG. 1 is an exploded isometric view of an electrical outlet according to the invention.
Figure 2:
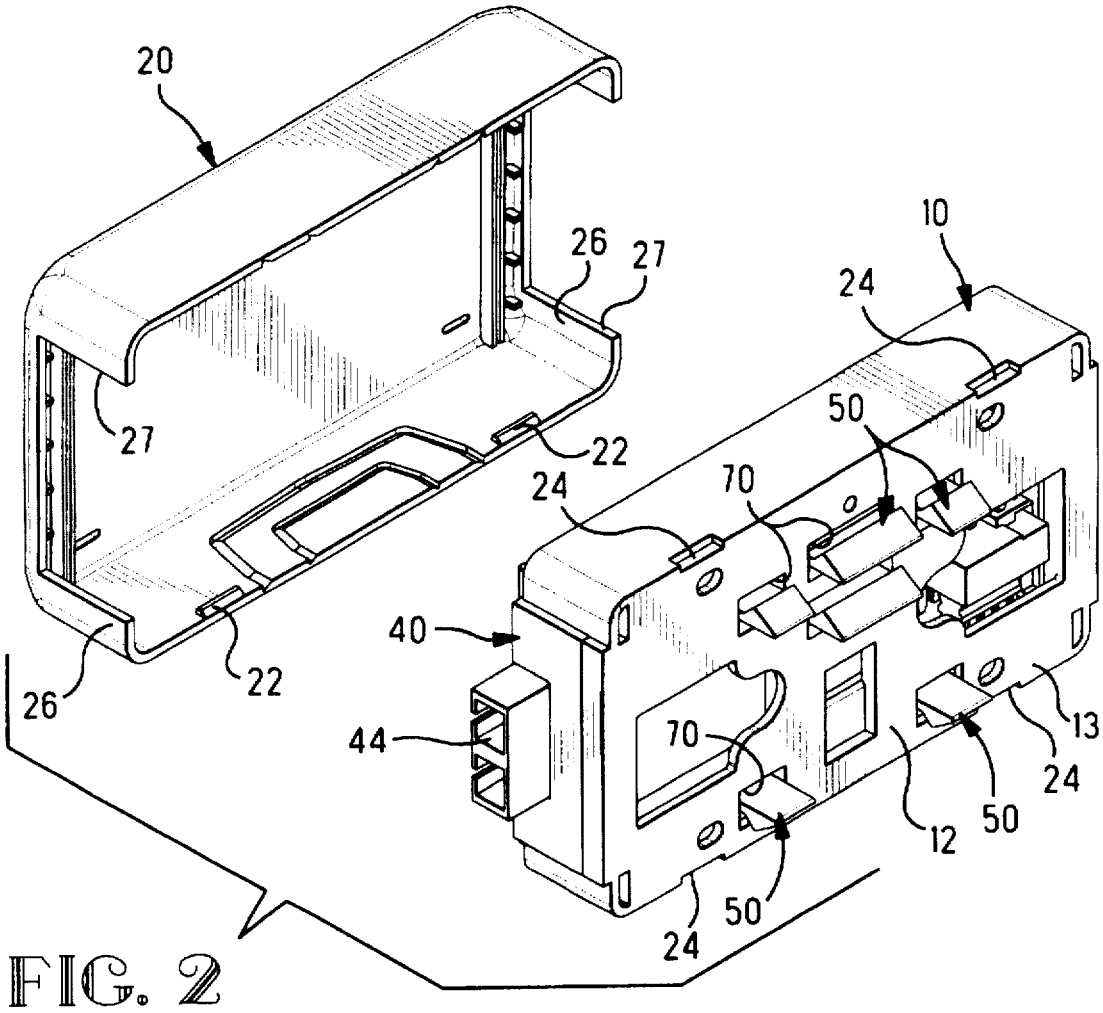
FIG. 2 is an exploded isometric view of the outlet from a reverse direction.
Figure 3:
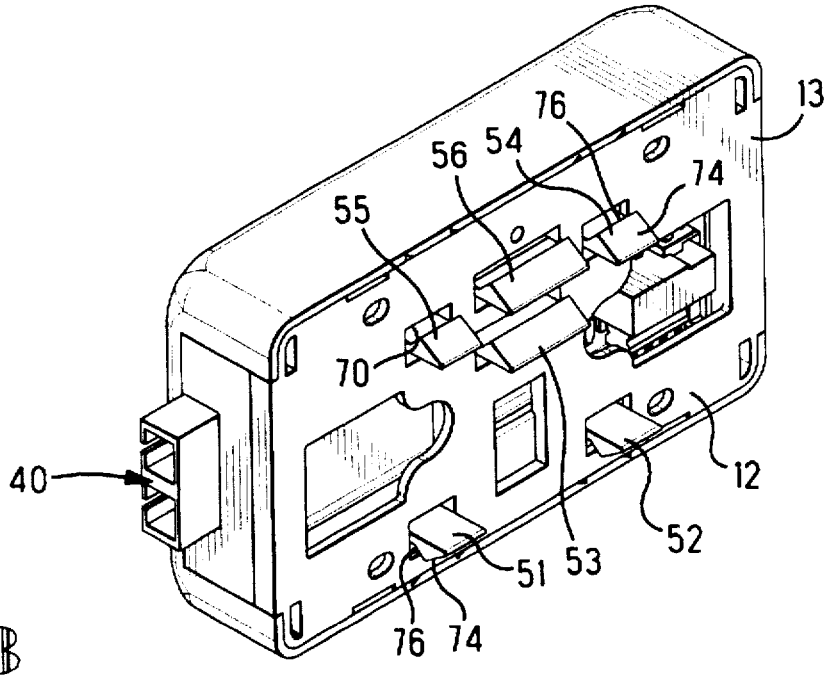
FIG. 3 is an isometric view of the outlet in assembled condition.

There is shown in FIGS. 1–3 an electrical outlet comprising a base 10 and a cover 20. The base 10 includes a plate 12, side walls 14, end walls 16 and retainer walls 18. The plate 12 is dimensioned to extend across a cutout in a wall panel (not shown) with a rear surface 13 of the plate confronting the wall panel at least on opposite sides of the cutout. The wall panel may be, for example, a raceway in a modular furniture unit.

Each of the retainer walls 18 extends parallel to one of the end walls 16 and is spaced from its associated end wall by a gap which defines a slot 32. Each associated pair of end wall 16 and retainer wall 18 has aligned cutouts 36, 38. Inserts 40 comprising one or more standard electrical connectors such as modular jacks 42 or a fiber optic connector 44 are insertable in the slots 32 with the connectors extending through the cutouts 36, 38. The inserts 40 are interchangeable in either one of the slots 32.

Each of the inserts 40 includes a plate portion 46 to which the connectors 42, 44 are attached such as by latches or integral molding. The plate portion 46 is dimensioned to be received in the slot 32 between the end wall and the retainer wall. The plate portion 46 has notches 48 which can receive projections 30 on the retainer wall 18. The projections 30 are formed on end portions of the retainer wall 18 on opposite sides of the cutout 38. The end portions of the retainer wall are somewhat resilient due to their cantilever beam configuration, and the projections 30 at free ends of the cantilever beams are deflected by the plate portion 46 during insertion or withdrawal of the insert 40 into or from the slot 32. The inserts 40 are removably secured to the base 10 by the projections 30 residing in the notches 48.

As best seen in FIG. 2, the cover 20 is latchably securable to the base 10 by projections 22 of the cover which are receivable in recesses 24 of the base. The cover has end walls 26 with cutouts 27 which cooperate with the end walls 16 and retainer walls 18 to accommodate the inserts. The cover has a boss 28 which can receive a threaded fastener for securing a label holder to a front of the cover.

The base has a plurality of latch members 50, shown in FIG. 2, which extend beyond the rear surface 13 of the plate 12. The latch members are configured to extend through a cutout in a wall panel (not shown) and to engage a rear of the wall panel to latchably secure the base to the wall panel.

With reference to FIG. 3, the latch members are arranged in three arrays corresponding to three standard sizes of a cutout. A first array comprises latch members 51, 52, 53; a second array comprises latch members 51, 52, 54, 55; and a third array comprises latch members 51, 52, 56. Thus, the latch members 51, 52 are common to all three of the arrays and may be termed basic latch members, whereas the latch members 53, 54, 55, 56 are specific to a particular array and may be termed dedicated latch members. For each of the arrays, the dedicated latch member(s) are vertically spaced from the basic latch members by a dimension corresponding to a height of one of the standard sizes of cutouts. The dedicated latch members may be selectively detached from the base so that the remaining latch members are all included within a projected area corresponding to the area of a particular one of the standard sizes of cutouts. More specifically, the dedicated latch members of large arrays may be detached from the base so that the largest remaining array corresponds to a cutout of relatively smaller size.

Figure 4:
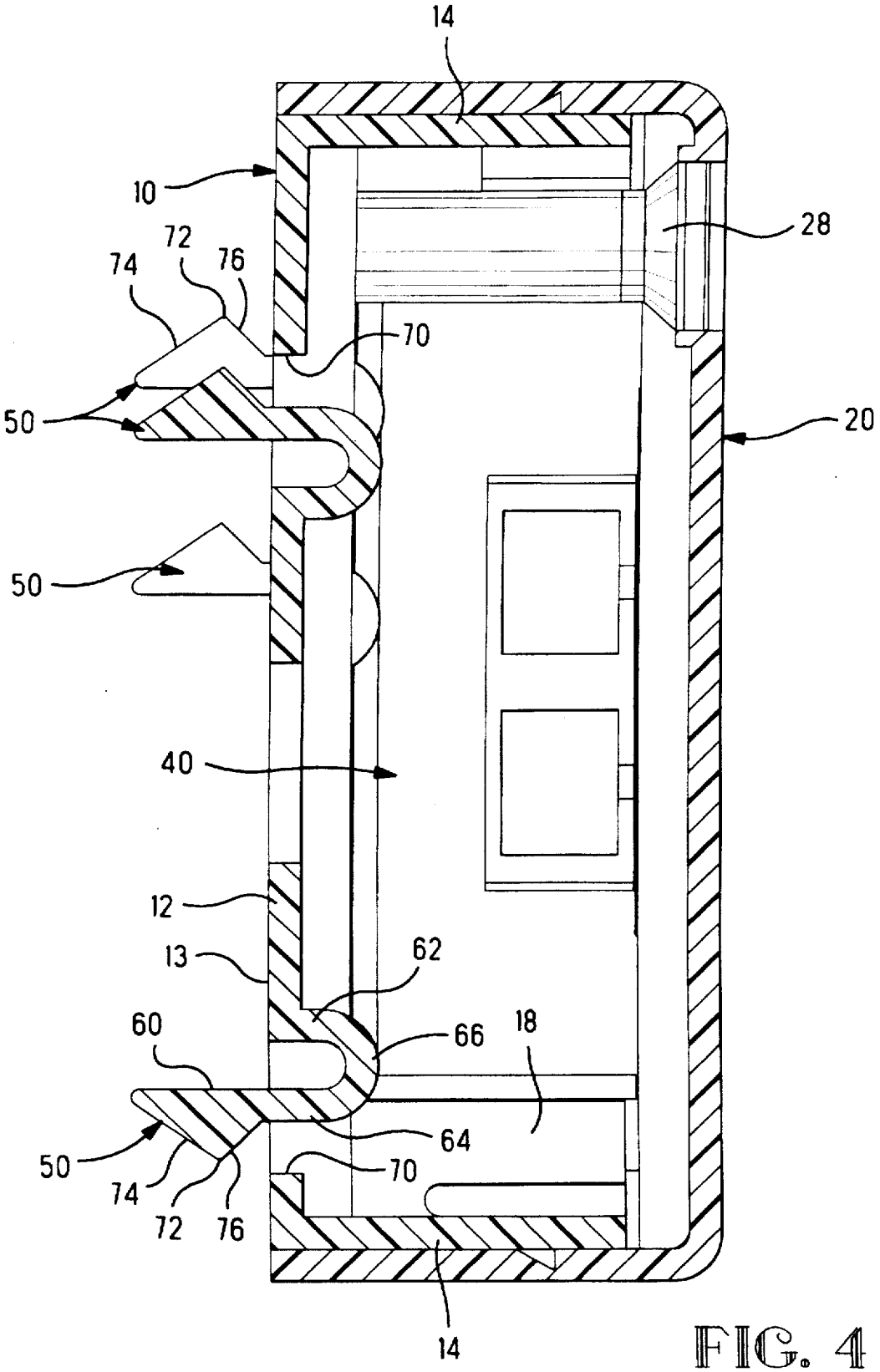
FIG. 4 is an enlarged cross-sectional view through the outlet.

Details of the latch members 50 are shown in FIG. 4. Each of the latch members 50 includes a resilient latch arm 60 which is connected to the plate 12 and formed integrally with the base by molding. The latch arm 60 includes a frangible section near a root of the latch arm at its junction with the base 12 which may be defined by a perforated, scored, or relatively thin area of the latch arm, thereby facilitating selective detachment of the latch arm from the base. The latch arm 60 extends along a course that includes both a forwardly extending section 62 and rearwardly extending section 64, thereby increasing the overall length of the latch arm, which increases flexibility. In a preferred embodiment the latch arm first extends forwardly from the plate 12 and then reverses course through a U-shaped section 66 and extends in the rearward direction. The latch arm extends rearwardly through an aperture 70 in the plate 12 and continues beyond the rear face 13 of the plate. A projection 72 at an end of the latch arm 60 has an inclined leading face 74 and an inclined trailing face 76.

The base 10 is best installed on a wall panel by tilting a top of the base forward and downward so that the basic latch members 51, 52 can be inserted first through the cutout and placed on a bottom edge of the cutout. The base is then rotated back so that the dedicated latch member(s) of the appropriate size array will enter the cutout. At this time, the inclined leading face 74 of the dedicated latch member(s) will engage a top edge of the cutout, thereby facilitating deflection of the latch arm 60 and preventing snagging of the projection 72 on the wall panel. When the projection 72 emerges through the wall panel, the latch arm resiles and the wall panel is captured between the projection 72 and the rear face 13 of the plate 12.

The trailing face 76 helps the latch arm to accommodate panels of different thicknesses. The inclined trailing face 76 is configured to engage a corner of the panel where a rear surface of the panel meets an edge of the cutout. Since a front surface of the panel is always flush with the rear face 13 of the plate, wall panels which differ in thickness will engage the trailing face 76 at different positions therealong but will always be firmly captured.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

I claim:

1. An electrical outlet which is mountable over a cutout of known size in a wall panel, wherein the known size is one in a range of different standard sizes, the outlet comprising:

a base including a plate which is dimensioned to extend across the cutout and to confront the wall panel, and a plurality of latch arms extending forwardly from the plate and then rearwardly through apertures in the plate and continuing rearwardly to extend through the cutout, the latch arms being configured for engaging the wall panel when extending through at least one of the standard sizes of the cutout, the latch arms being arranged in arrays of different sizes corresponding to the different standard sizes of the cutout, at least one of the latch arms in a relatively large size array being selectively detachable from the base, wherein a largest remaining array corresponds to the known size of the cutout.

2. The outlet according to claim 1, wherein the latch arms are formed integrally with the base.

3. The outlet according to claim 1, wherein each of the latch arms has a projection with an inclined trailing face that is engageable with the wall panel.

4. An electrical outlet which is mountable over a cutout of known size in a wall panel, wherein the known size is one in a range of different standard sizes, the outlet comprising:

a base including a plate which is dimensioned to extend across the cutout and to confront the wall panel, and a plurality of latch arms extending forwardly from the plate and then rearwardly through apertures in the plate and continuing rearwardly to extend through the cutout, the latch arms being configured for engaging the wall panel when extending through at least one of the standard sizes of the cutout, the latch arms being selectively detachable from the base wherein all of the remaining latch arms may extend through the known size cutout.

5. The outlet according to claim 4, wherein the latch arms are formed integrally with the base.

6. The outlet according to claim 4, wherein each of the latch arms has a projection with an inclined trailing face that is engageable with the wall panel.

7. An electrical outlet which is mountable over a cutout in a wall panel, the outlet comprising:

a base which is dimensioned to extend across the cutout, the base including a plate and a latch arm formed integrally with the plate, the latch arm extending forwardly from the plate and then rearwardly through an aperture in the plate and continuing rearwardly to extend through the cutout in the wall panel, the latch arm having a projection which is engageable with the wall panel for securing the base to the wall panel.

8. The electrical outlet according to claim 7, wherein the projection has an inclined trailing face which is engageable with the wall panel.

* * * * *